US007382340B2

(12) United States Patent
Kim et al.

(10) Patent No.: US 7,382,340 B2
(45) Date of Patent: Jun. 3, 2008

(54) LIGHT EMISSION DISPLAY, DISPLAY PANEL, AND DRIVING METHOD THEREOF

(75) Inventors: Yang-Wan Kim, Suwon-si (KR); Choon-Yul Oh, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 497 days.

(21) Appl. No.: 11/077,278

(22) Filed: Mar. 8, 2005

(65) Prior Publication Data

US 2005/0200575 A1 Sep. 15, 2005

(30) Foreign Application Priority Data

Mar. 10, 2004 (KR) ..... 10-2004-0016139

(51) Int. Cl.
*G09G 3/36* (2006.01)
*G09G 3/30* (2006.01)

(52) U.S. Cl. ..... 345/76; 345/78; 345/92

(58) Field of Classification Search ..... 345/55–100, 345/204–214; 315/169.1–169.4
See application file for complete search history.

(56) References Cited

U.S. PATENT DOCUMENTS

| | | | | |
|---|---|---|---|---|
| 6,229,506 | B1 | 5/2001 | Dawson et al. | |
| 7,277,071 | B2 * | 10/2007 | Oh | 345/76 |
| 2003/0209990 | A1 | 11/2003 | Kawasaki et al. | |
| 2004/0217925 | A1 * | 11/2004 | Chung et al. | 345/76 |
| 2005/0007316 | A1 * | 1/2005 | Akimoto et al. | 345/76 |

FOREIGN PATENT DOCUMENTS

| | | |
|---|---|---|
| EP | 1 441 325 A2 | 7/2004 |
| EP | 1 441 325 A3 | 7/2004 |
| JP | 2003-173165 | 6/2003 |
| JP | 2004-133240 | 4/2004 |
| WO | WO 98/48403 | 10/1998 |

OTHER PUBLICATIONS

EPO Search Report for application No. 05101764.8, dated Aug. 2, 2005, in the name of Samsung SDI Co., Ltd.
Patent Abstracts of Japan for publication No. 2003-173165; dated Jun. 20, 2003 in the name of Yoshiaki Aoki.
Patent Abstracts of Japan for publication No. 2004-133240; dated Apr. 30, 2004 in the name of Shin Asano, et al.

* cited by examiner

*Primary Examiner*—David L. Lewis
(74) *Attorney, Agent, or Firm*—Christie, Parker & Hale, LLP

(57) ABSTRACT

A light emission display includes data lines, scan lines, and pixel circuits. A pixel circuit of the pixel circuits includes: a light emission element; a first transistor including a control electrode and first and second electrodes, the first transistor outputting a current corresponding to a voltage between the first electrode and the control electrode; a first switch coupled between the control electrode of the first transistor and the light emission element and for receiving a first control signal; a first capacitor coupled to the first transistor; a second capacitor coupled between a first power source and the first capacitor; a second switch for coupling the first capacitor and a second power source in response to a second control signal; and a third switch for applying a data voltage to the first capacitor in response to a select signal provided by one of the scan lines.

22 Claims, 8 Drawing Sheets

LIGHT EMISSION DISPLAY, DISPLAY PANEL, AND DRIVING METHOD THEREOF

CROSS REFERENCE TO RELATED APPLICATION

This application claims priority to and the benefit of Korea Patent Application No. 10-2004-0016139 filed on Mar. 10, 2004 in the Korean Intellectual Property Office, the entire content of which is incorporated herein by reference.

BACKGROUND OF THE INVENTION (a) Field of the Invention

The present invention relates to a display device. More specifically, the present invention relates to an organic electroluminescent (EL) display, a display panel, and a driving method thereof.

(b) Description of the Related Art

In general, an organic electroluminescent (EL) display is a display device that electrically excites a phosphorous organic compound in a plurality of organic light emitting diodes (OLEDs) to emit light. The organic EL display voltage- or current-drives N×M organic emitting cells to display images. An organic emitting cell of the organic EL display includes an anode (ITO), an organic thin film, and a cathode layer (metal). The organic thin film has a multi-layer structure including an emitting layer (EML), an electron transport layer (ETL), and an hole transport layer (HTL) for maintaining balance between electrons and holes and improving emitting efficiencies, and it further includes an electron injecting layer (EIL) and an hole injecting layer (HIL).

Methods for driving the organic emitting cells include the passive matrix method, and the active matrix method using thin film transistors (TFTs) or MOSFETs. The passive matrix method forms cathodes and anodes to cross (or cross over) with (or perpendicular to) each other, and selects lines to drive the organic emitting cells. The active matrix method connects a TFT and a capacitor with each indium tin oxide (ITO) pixel electrode to thereby maintain a predetermined voltage according to a capacitance of the capacitor. The active matrix method can further be classified as a voltage programming method or a current programming method according to signal forms supplied for maintaining a voltage at a capacitor.

FIG. 1 shows a conventional pixel circuit for driving an organic EL element using TFTs and representatively illustrates a pixel circuit coupled to a data line Dm and a scan line Sn from among N×M pixel circuits (or cells). As shown, a driving transistor M1 is coupled to an organic EL element OLED to supply a current for light emission thereto. The current of the driving transistor M1 is controlled by a data voltage applied through a switching transistor M2. A capacitor Cst (or a storage capacitor) for maintaining the applied voltage for a predetermined time is coupled between a source and a gate of the driving transistor M1. A gate of the transistor M2 is coupled to a scan line Sn, and a source thereof is coupled to a data line Dm.

In operation, when the transistor M2 is turned on by a select signal applied to the gate of the transistor M2, a data voltage is applied to the gate of the transistor M1 through the data line Dm, and the current flows to the organic EL element OLED through the transistor M1 in correspondence to the data voltage applied to the gate of the transistor M1 to thus generate light emission.

The current flowing to the organic EL element OLED in this instance is given in Equation 1.

$$I_{OLED} = \frac{\beta}{2}(Vgs - Vth)^2 = \frac{\beta}{2}(VDD - Vdata - |Vth|)^2 \quad \text{Equation 1}$$

where $I_{OLED}$ is a current flowing to the organic EL element OLED, Vgs is a voltage between the gate and the source of the transistor M1, Vth is a threshold voltage of the transistor M1, Vdata is a data voltage, and β is a constant.

As given in Equation 1, a current corresponding to the applied data voltage (Vdata) is supplied to the organic EL element OLED, and the organic EL element OLED then emits light in correspondence to the supplied current in the pixel circuit of FIG. 1.

In addition, a voltage (VDD) supply line for supplying the voltage of VDD to the pixel circuit is shown in FIG. 1 as a horizontal line or a vertical line. Referring now to FIG. 2, when multiple transistors are driven, the voltage (VDD) supply line applied to the pixel circuit can be represented as a horizontal line. In the case of FIG. 2, loads (impedance) at the transistors are increased, a large amount of currents are spent, and a voltage drop is generated between a voltage supply point of a first transistor of an input terminal and a voltage supply point of a transistor of a last terminal. As such, the voltage of VDD applied to a right pixel circuit 20 of the voltage (VDD) supply line is lower than the voltage of VDD applied to a left pixel circuit 25, and a long range (LR) uniformity problem is generated in FIG. 2. The voltage drop problem of the voltage (VDD) supply line is varied depending on design conditions to which the input of the voltage (VDD) supply line is coupled.

Also, a short range (SR) uniformity problem is generated because the amount of currents supplied to the organic EL element OLED is varied by a deviation of the threshold voltage (Vth) of a thin-film transistor (TFT) caused by non-uniformity of the manufacturing process, in addition to a brightness difference generated by a voltage drop of the above-described voltage (VDD) supply line.

To solve the problems, FIG. 3 shows a pixel circuit for preventing non-uniformity of brightness caused by variation of the threshold voltage (Vth) at the driving transistor M1, and FIG. 4 shows a drive timing diagram for driving the circuit of FIG. 3.

It is needed in the circuit of FIGS. 3 and 4 for a data voltage for driving a driving transistor to correspond to the voltage of VDD while a control signal of a signal line AZn is at a low-level. Further, when the control signal of the signal line AZn is at a high-level and a low-level data voltage is applied to a data line Dm, the voltage between a gate and a source of a driving transistor M1 is given in Equation 2.

$$Vgs = Vth - \frac{C1}{C1 + C2}(VDD - Vdata) \quad \text{Equation 2}$$

where Vth is a threshold voltage at the transistor M1, Vdata is a data voltage, and VDD is a power supply voltage. However, since the data voltage is divided by capacitors (or capacitances) C1 and C2 as is shown from Equation 2, the pixel circuit of FIG. 3 is restricted in that it must either have a high data voltage (Vdata) or a high capacitance at the capacitor C1 to compensate for the capacitances at the capacitors C1 and C2.

SUMMARY OF THE INVENTION

It is an aspect of the present invention to provide a display device and/or method for compensating a deviation of a threshold voltage of a driving transistor included in a pixel circuit and for representing uniform brightness.

It is another aspect of the present invention to provide a display device and/or method for compensating a difference of a voltage drop amount between pixel circuits generated by a driving voltage line and for representing uniform brightness.

In one embodiment of the present invention, a display device is provided. The display device includes a plurality of data lines for applying a data voltage corresponding to an image signal, a plurality of scan lines for applying a select signal, and a plurality of pixel circuits coupled to the scan lines and the data lines. At least one of the pixel circuits includes: a display element for displaying the image signal corresponding to an applied current; a first transistor including a control electrode, a first electrode coupled to a first power source, and a second electrode coupled to the display element, the first transistor outputting the applied current corresponding to a voltage between the first electrode and the control electrode; a first switch coupled between the control electrode of the first transistor and the light emission element and for receiving a first control signal; a first capacitor having a first capacitor electrode coupled to the control electrode of the first transistor and a second electrode; a second capacitor coupled between the first power source and the second capacitor electrode of the first capacitor; a second switch for coupling the second capacitor electrode of the first capacitor and a second power source in response to a second control signal; and a third switch for applying a data voltage provided by one of the data lines to the second capacitor electrode of the first capacitor in response to a first select signal provided by one of the scan lines.

In one exemplary embodiment t of the present invention, a display panel of a light emission display includes a plurality of data lines for applying a data voltage corresponding to an image signal, a plurality of scan lines for applying a select signal, and a plurality of pixel circuits coupled to the scan lines and the data lines. At least one of the pixel circuits includes: a display element for displaying the image signal corresponding to an applied current; a transistor including a control electrode, a first electrode coupled to a first power, and a second electrode coupled to the display element, the first transistor outputting the applied current corresponding to a voltage applied between the control electrode and the first electrode to the second electrode; a first capacitor having a first capacitor electrode coupled to the control electrode of the transistor and a second capacitor electrode; and a second capacitor coupled between the first power source and the second capacitor electrode of the first capacitor. The at least one pixel circuit is operated in the order of a first interval in which the second capacitor electrode of the first capacitor is coupled to a second power source to charge the first capacitor, a second interval in which the second capacitor is charged with a data voltage provided by one of the data lines, and a third interval in which the second electrode of the transistor and the display element are coupled to display the image signal.

In one embodiment of the present invention, a method for driving a plurality of pixel circuits in a matrix format is provided. At least one of the pixel circuits includes a light emission element for emitting light in correspondence to an applied current; a transistor being coupled between a first power source and the light emission element and outputting the applied current corresponding to a voltage applied to a gate of the transistor; a first capacitor having a first capacitor electrode coupled to the gate of the first transistor and a second capacitor electrode; and a second capacitor coupled between the first power source and the second capacitor electrode of the first capacitor. The method for driving the pixel circuits includes: (a) charging the first capacitor with a voltage of a second power source separately formed from a threshold voltage of the transistor and a voltage of the first power source; (b) charging the second capacitor with a voltage corresponding to a data voltage provided by one of the data lines; and (c) driving the transistor according to the voltages charged in the first and second capacitors.

In one embodiment of the present invention, a pixel circuit is provided. The pixel circuit is coupled to a first scan line for applying a first signal, a second scan line for applying a second signal, and a data line for applying a data voltage and includes: a driving transistor, a display element, a first switching transistor, a compensation device, a storage capacitor, and a second switching transistor. The driving transistor includes a control electrode, a first electrode coupled to a first power source, and a second electrode and is for outputting a current corresponding to a voltage between the first electrode and the control electrode. The displaying element is coupled to the second electrode of the driving transistor and is for displaying an image corresponding to the current output from the driving transistor. The first switching transistor is coupled between the control electrode of the driving transistor and the display element. The compensation device is for electrically coupling the control electrode of the driving transistor to a second source in response to the first signal. The storage capacitor is coupled between the first power source and compensation device. The second switching transistor is for applying the data voltage to the compensation device in response to the second signal.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
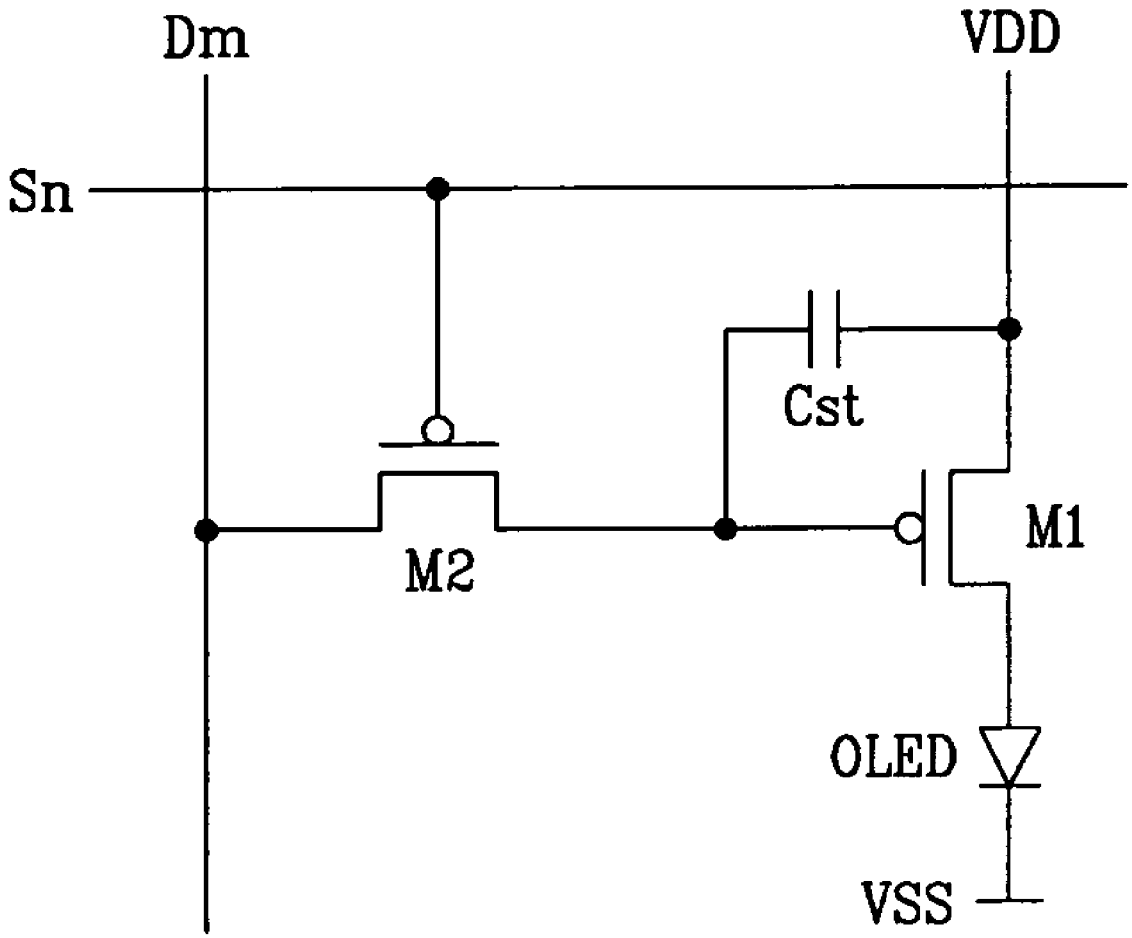
FIG.1 (Prior Art)
FIG. 1 shows a conventional pixel circuit for driving an organic EL element.
Figure 2:
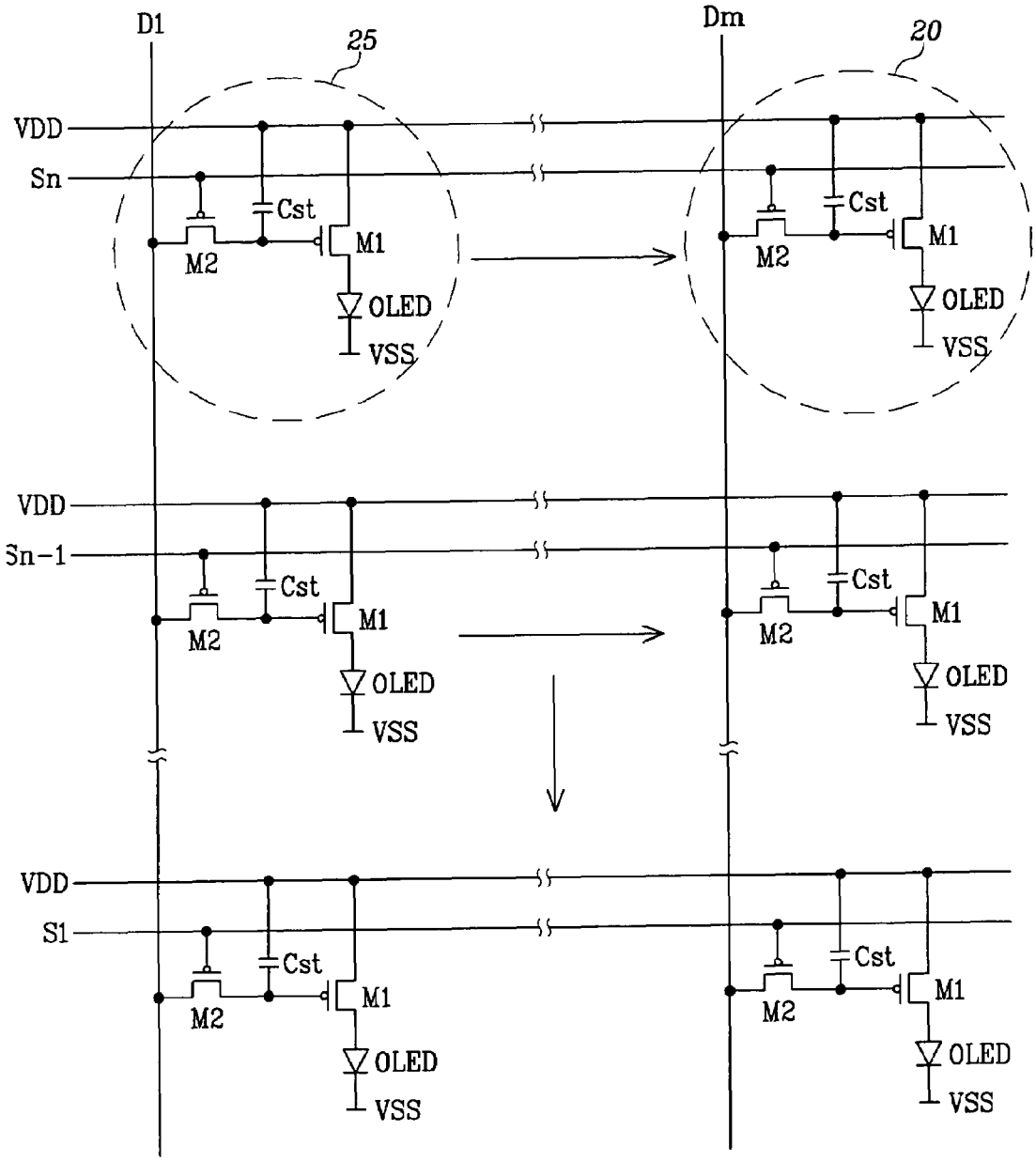
FIG.2 (Prior Art)
FIG. 2 shows a configuration diagram of a voltage supply line in a display panel of a general organic EL display.
Figure 3:
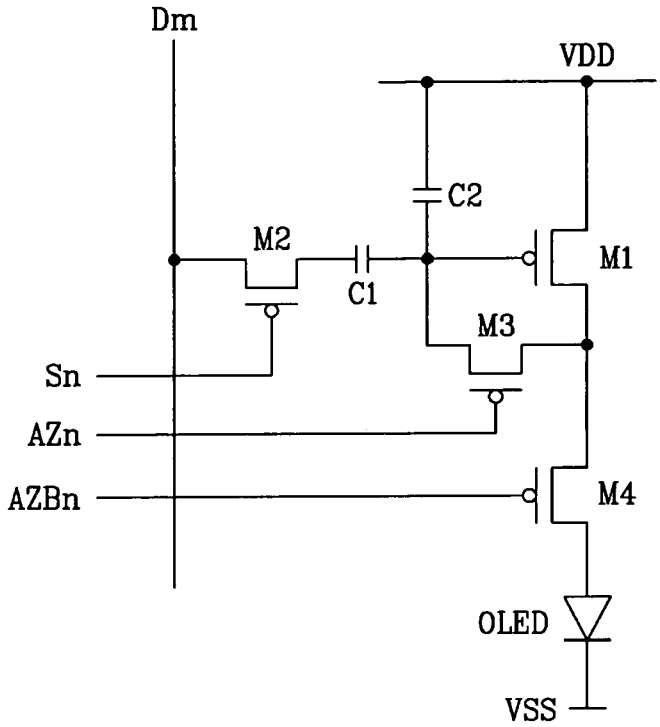
FIG.3 (Prior Art)
FIG. 3 shows a conventional pixel circuit.
Figure 4:
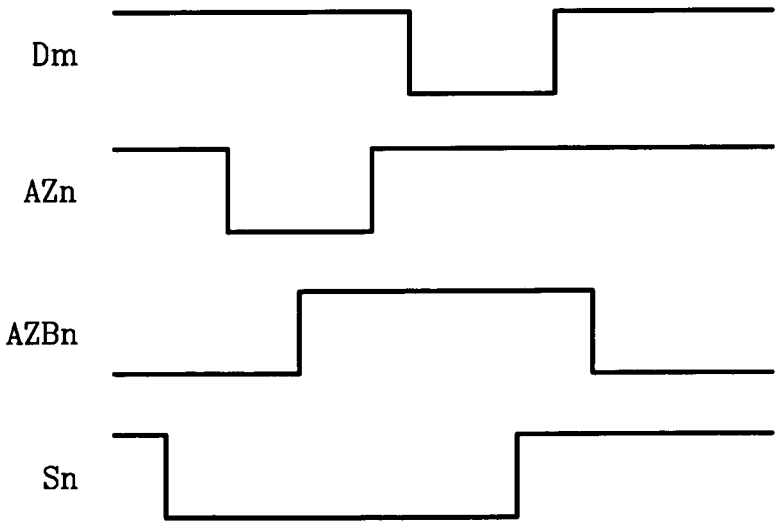
FIG.4 (Prior Art)
FIG. 4 shows a drive timing diagram for driving the circuit of FIG. 3.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. To clarify the present invention, certain components which are not described in the specification can be omitted, and like reference numerals indicate like components.

Figure 5:
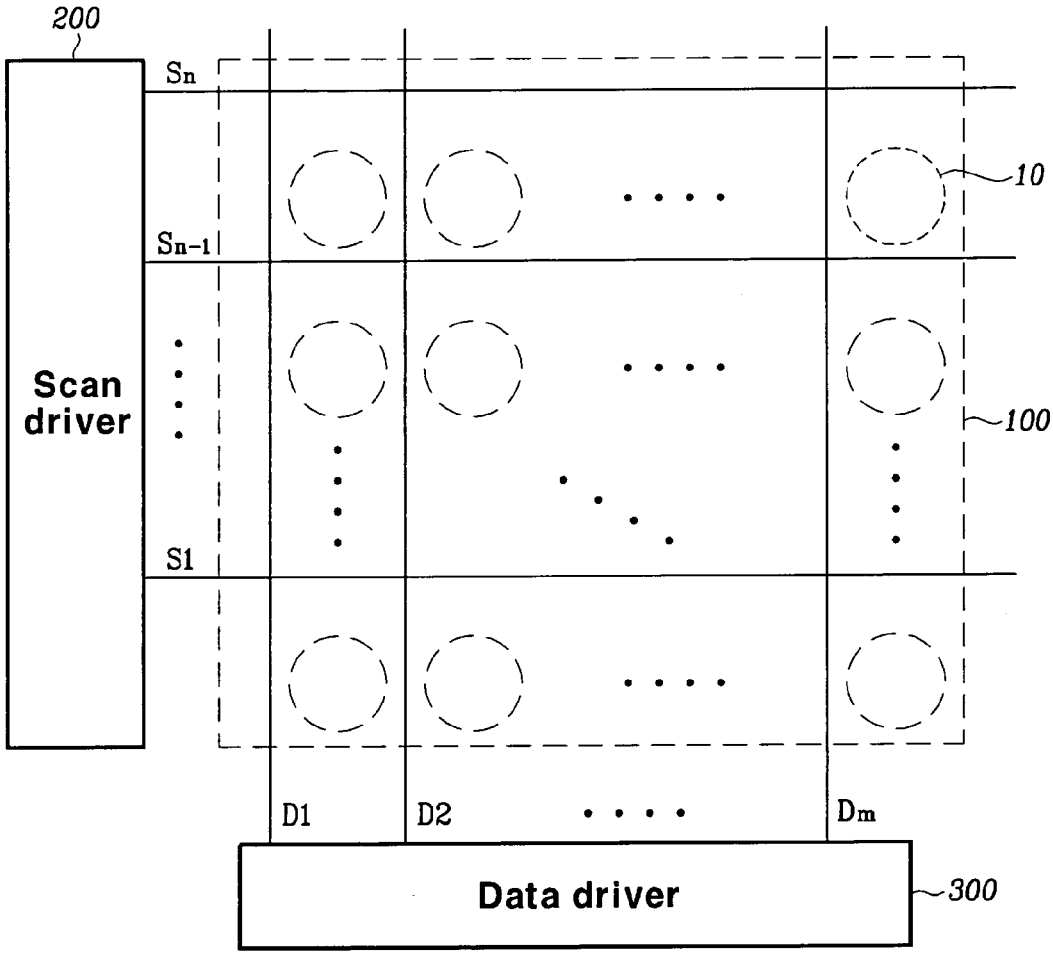
FIG. 5 shows a brief diagram of a light emission display according to certain exemplary embodiments of the present invention.

FIG. 5 shows a brief diagram of a light emission display according to certain exemplary embodiments of the present invention.

As shown, the light emission display includes an organic EL display panel 100, a scan driver 200, and a data driver 300.

The organic EL display panel 100 includes a plurality of data lines D1 to Dm arranged in a column direction, a plurality of scan lines S1 to Sn arranged in a row direction, and a plurality of pixel circuits 10. The data lines D1 to Dm apply data voltages for displaying image signals to the pixel circuits 10, and the scan lines S1 to Sn apply select signals to the pixel circuits 10. Each pixel circuit 10 is formed at a pixel area defined by two adjacent data lines D1 to Dm, and two adjacent scan lines S1 to Sn.

The scan driver 200 sequentially applies select signals to the scan lines S1 to Sn, and the data driver 300 applies the data voltage for displaying image signals to the data lines D1 to Dm.

The scan driver 200 and/or the data driver 300 can be coupled to the display panel 100, or can be installed, in a chip format, in a tape carrier package (TCP) coupled to the display panel 100. The same can be coupled to the display panel 100, and installed, in a chip format, on a flexible printed circuit (FPC) or a film coupled to the display panel 100. Differing from this, the scan driver 200 and/or the data driver 300 can be installed on a glass substrate of the display panel 100 and can be substituted for a driving circuit formed in layers identical with that of the scan lines, the data lines, and TFTs on the glass substrate.

Figure 6:
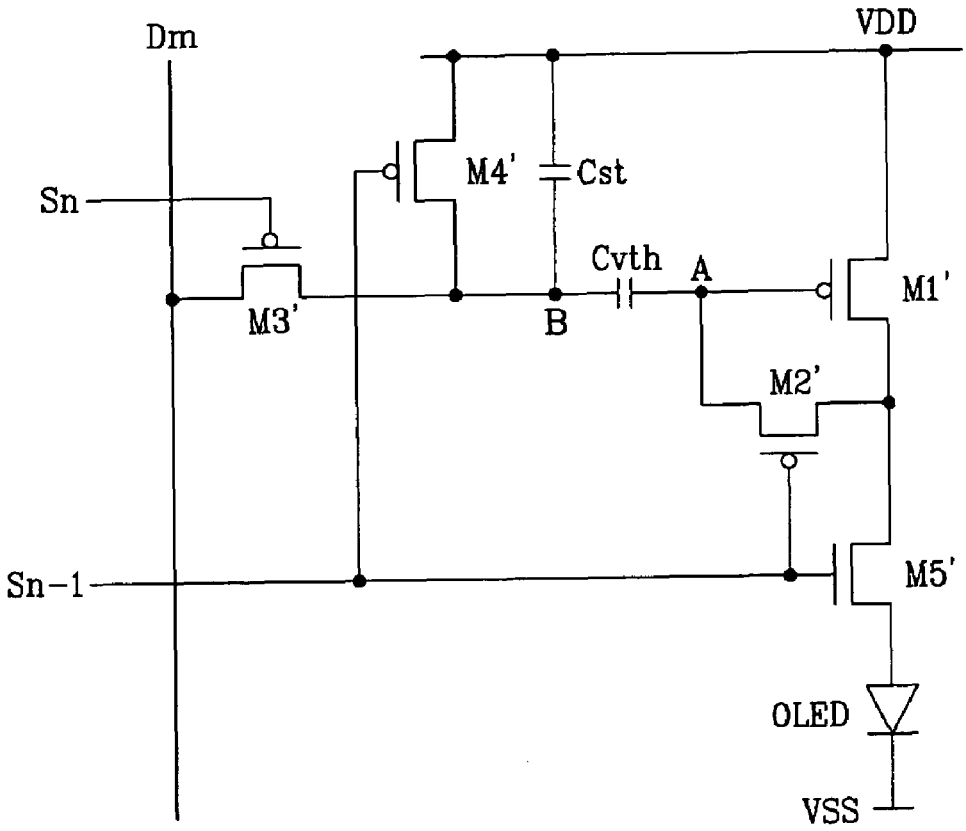
FIG. 6 shows an equivalent circuit diagram of a pixel circuit according to a first exemplary embodiment of the present invention.

FIG. 6 shows an equivalent circuit diagram of a pixel circuit according to the first exemplary embodiment of the present invention. For ease of description, FIG. 6 shows a pixel circuit coupled to the m-th data line Dm and the n-th scan line Sn. In addition, as to terminology of the scan lines, the scan line for applying the current select signal is referred to as the "current scan line," and the scan line which has transmitted a select signal before the current select signal is transmitted is referred to as the "previous scan line."

As shown in FIG. 6, the pixel circuit (e.g., the pixel circuit 10 of FIG. 5) according to the exemplary embodiment of the present invention includes transistors M1', M2', M3', M4' and M5', capacitors Cst and Cvth, and an organic EL element OLED.

The transistor M1' is a driving transistor for driving the organic EL element OLED. The transistor M1' is coupled between a power source for supplying the voltage VDD and the organic EL element OLED and controls the current flowing to the organic EL element OLED through the transistor M5' according to the voltage applied to the gate of the transistor M1'. The transistor M2' has a first electrode coupled to the capacitor Cvth and a second electrode coupled to an anode electrode of the organic EL element OLED through the transistor M5'. The transistor M2' diode-connects the transistor M1' in response to the select signal provided by the previous scan line Sn−1.

The gate of the transistor M1' is coupled to a first capacitor electrode A of the capacitor Cvth, and the transistor M4' is coupled in parallel between a second capacitor electrode B of the capacitor Cvth and the power source for supplying the voltage VDD. The transistor M4' supplies the voltage VDD to a second capacitor electrode B of the capacitor Cvth in response to the select signal provided by the previous scan line Sn−1.

The transistor M3' transmits the data provided by the data line Dm to the second capacitor electrode B of the capacitor Cvth in response to the select signals provided by the current scan line Sn.

The transistor M5' is coupled between a drain of the transistor M1' and an anode of the organic EL element OLED, and can interrupt an electrical connection of the drain of the transistor M1' and the organic EL element OLED in response to the select signals provided by the previous scan line Sn−1.

The organic EL element OLED emits light in correspondence to the input current supplied thereto through the transistor M5'. A voltage of VSS coupled to a cathode of the organic EL element OLED is lower than the voltage VDD. The voltage of VSS can include a ground voltage.

Figure 7:
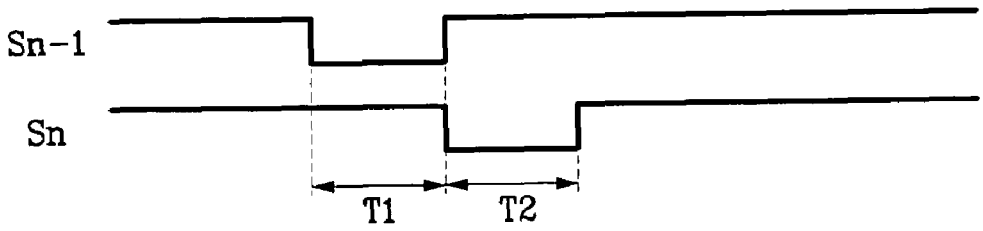
FIG. 7 shows a driving waveform diagram for driving the pixel circuit shown in FIG. 6.

An operation of the pixel circuit according to the first exemplary embodiment of the present invention will be described with reference to FIG. 7.

In the interval of T1, the transistor M2' is turned on and the transistor M1' is diode-connected when a low-level scan voltage is applied to the previous scan line Sn−1. Hence, the voltage between the gate and the source of the transistor M1' is varied until it reaches the threshold voltage (Vth) at the transistor M1'. In this instance, the voltage applied to the gate of the transistor M1', that is, the first capacitor electrode A of the capacitor Cvth, becomes the sum voltage of the power supply voltage and the threshold voltage (VDD+Vth) since the voltage VDD is applied to the source of the transistor M1'. Also, the transistor M4' is turned on, and the voltage of VDD is applied to the second capacitor electrode B of the capacitor Cvth.

Therefore, the voltage between both electrodes of the capacitor Cvth is given in Equation 3.

$$V_{Cvth}=C_{CvthA}-V_{CvthB}=(VDD+Vth)-VDD=Vth \qquad \text{Equation 3}$$

where VCvth is a voltage at both electrodes of the capacitor Cvth, VCvthA is a voltage at the first capacitor electrode A of the capacitor Cvth, and VCvthB is a voltage at the second capacitor electrode B of the capacitor Cvth.

Also, the transistor M5' has a different channel type from the transistor M2' or is doped to have a different type of major carriers from the transistor M2' or is an N-type channel. As such, the transistor M5' is turned off in the interval of T1 to prevent the current flowing from the transistor M1' to the organic EL element OLED, and the transistor M3' is turned off since a high-level signal is applied to the current scan line Sn.

In the interval of T2, the transistor M3' is turned on and the data voltage of Vdata is charged in the capacitor Cst when a low-level scan voltage is applied to the current scan line Sn. Also, the voltage which corresponds to the sum of the data voltage (Vdata) and the threshold voltage (Vth) at the transistor M1' is applied to the gate of the transistor M1' since the capacitor Cvth is charged with the voltage which corresponds to the threshold voltage (Vth) at the transistor M1'.

That is, the voltage (Vgs) between the gate and the source of the transistor M1' is given in Equation 4, and the current given in Equation 5 is supplied to the organic EL element OLED through the transistor M1'.

$$Vgs = (Vdata + Vth) - VDD \quad \text{Equation 4}$$

$$\begin{aligned} I_{OLED} &= \frac{\beta}{2}(Vgs - Vth)^2 \\ &= \frac{\beta}{2}((Vdata + Vth - VDD) - Vth))^2 \\ &= \frac{\beta}{2}(VDD - Vdata)^2 \end{aligned} \quad \text{Equation 5}$$

where $I_{OLED}$ is a current flowing to the organic EL element OLED, Vgs is a voltage between the source and the gate of the transistor M1', Vth is a threshold voltage at the transistor M1', Vdata is a data voltage, and β is a constant.

As can be derived from Equation 5, a substantially constant or uniform current can be applied to the organic EL element OLED since the deviations of the threshold voltages of Vth are compensated by the capacitor Cvth if the threshold voltage of Vth at the transistor M1' for each pixel are different. Therefore, a non-uniform brightness problem or luminescence imbalance caused by locations of pixels is overcome.

However, in the above described case, the voltage VDD is dropped because of the internal resistance of the voltage (VDD) supply line when the current flows to the driving transistor M1' when programming the data voltage. In this instance, the dropped voltage is in proportion to the current flowing from the voltage (VDD) supply line. Accordingly, a non-uniformity in the brightness of the organic EL element OLED may result because when the same data voltage (Vdata) is applied, different voltages (Vgs) may be applied to the driving transistor M1', and different currents ($I_{OLED}$) may flow to the organic EL element (OLED) as can be derived from Equation 5.

Figure 8:
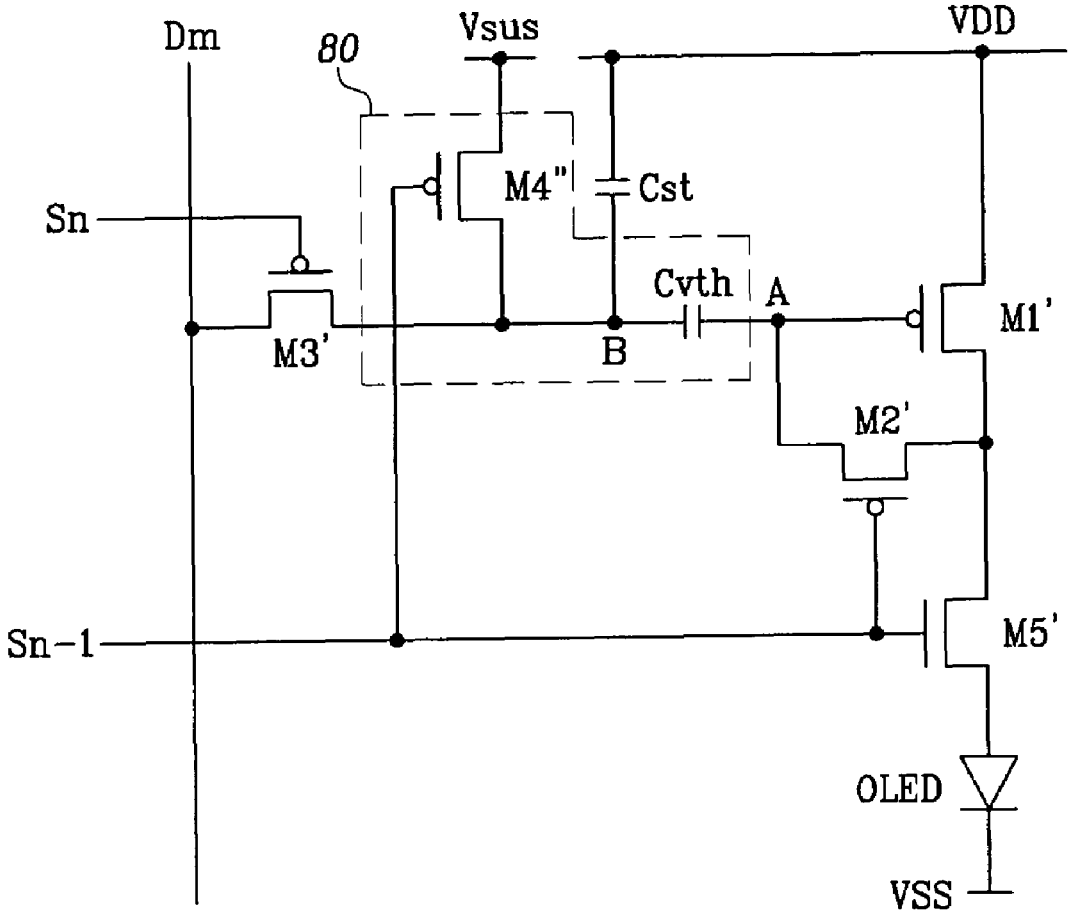
FIG. 8 shows a pixel circuit according to a second exemplary embodiment of the present invention.

FIG. 8 shows a pixel circuit according to the second exemplary embodiment of the present invention. The second exemplary embodiment includes a compensation device 80 that includes the transistor M4" and the capacitor Cvth.

As shown, the pixel circuit according to the second exemplary embodiment differs from the pixel circuit according to the first exemplary embodiment by applying a compensation voltage (Vsus) to the source of the transistor M4". An operation of the pixel circuit shown in FIG. 8 will be described.

In a first interval (e.g., the interval T1 of FIG. 1), when a low-level voltage is applied to the previous scan line Sn−1, the transistor M1' is diode-connected, and the voltage between the gate and the source of the transistor M1' is varied until it reaches the threshold voltage (Vth) at the transistor M1'. Hence, the voltage which corresponds to the sum of the voltage VDD and the threshold voltage (Vth) at the transistor M1' is applied to the gate of the transistor M1', that is, the first capacitor electrode A of the capacitor Cvth.

Also, when the transistor M4" is turned on, the compensation voltage (Vsus) is applied to the second capacitor electrode B of the capacitor Cvth, and the voltage given in Equation 6 is charged in the capacitor Cvth.

$$V_{Cvth} = (VDD + Vth) - Vsus \quad \text{Equation 6}$$

In the first interval, the transistors M3' and M5' are maintained at an off or interruption state.

In a second interval (e.g., the interval T2 of FIG. 1), a low-level voltage is applied to the current scan line Sn, and the transistor M3' is turned on. Therefore, the data voltage (Vdata) is charged in the capacitor Cst, and the voltage between the gate and the source of the transistor M1' is given in Equation 7 since the capacitor Cvth is charged with the voltage given in Equation 6.

$$Vgs = (Vdata + (VDD + Vth - Vsus)) - VDD = Vdata + Vth - Vsus| \quad \text{Equation 7}$$

Accordingly, the current flowing to the organic EL element is given in Equation 8.

$$\begin{aligned} I_{OLED} &= \frac{\beta}{2}(Vgs - Vth)^2 \\ &= \frac{\beta}{2}((Vdata + Vth - Vsus) - Vth)^2 \\ &= \frac{\beta}{2}(Vdata - Vsus)^2 \end{aligned} \quad \text{Equation 8}$$

As can be derived from Equation 8, the current flowing to the organic EL element of the second exemplary embodiment is not influenced by the voltage VDD, and the brightness deviation caused by the voltage drop in the voltage (VDD) supply line is compensated.

In the pixel circuit according to the second exemplary embodiment of the present invention, no voltage drop problem caused by a current leakage is generated since the compensation voltage Vsus forms no current path differing from the power supply voltage VDD. Therefore, substantially the same compensation voltage Vsus can be applied to the pixel circuits, and a uniform current corresponding to the data voltage (Vdata) can flow to the organic EL element OLED.

Further, as can be derived from Equation 7 in the second exemplary embodiment, an absolute value of a value obtained by subtracting the compensation voltage Vsus from the sum of the data voltage (Vdata) and the threshold voltage (Vth) at the transistor M1' can be established to be greater than an absolute value of the threshold voltage (Vth) at the transistor M1'. As such, a voltage having the same level as that of the voltage VDD can be used for the compensation voltage Vsus.

Referring to FIG. 8, P-type transistors are used for the transistors M2', M3', M4" and an N-type transistor is used for the M5' transistor but the transistor types of the present invention are not limited to those shown. The transistors can be realized by any switches for on and off switching in response to control signals. Also, it is shown for the transistors M1', M2', M3', M4" and M5' to include TFTs which respectively have a gate electrode, a drain electrode, and a source electrode formed on a glass substrate of the display panel (e.g., the display panel 100 of FIG. 5) as a control electrode and two other electrodes, but the transistors are not limited to TFTs. The transistors can be realized by any transistors, each having a first electrode, a second electrode, and a third electrode, and outputting an output corresponding to a signal applied to the first and second electrodes to the third electrodes. Of course, those skilled in the art would recognize that the voltage polarities and levels may be different when other transistors are used.

Figure 9:
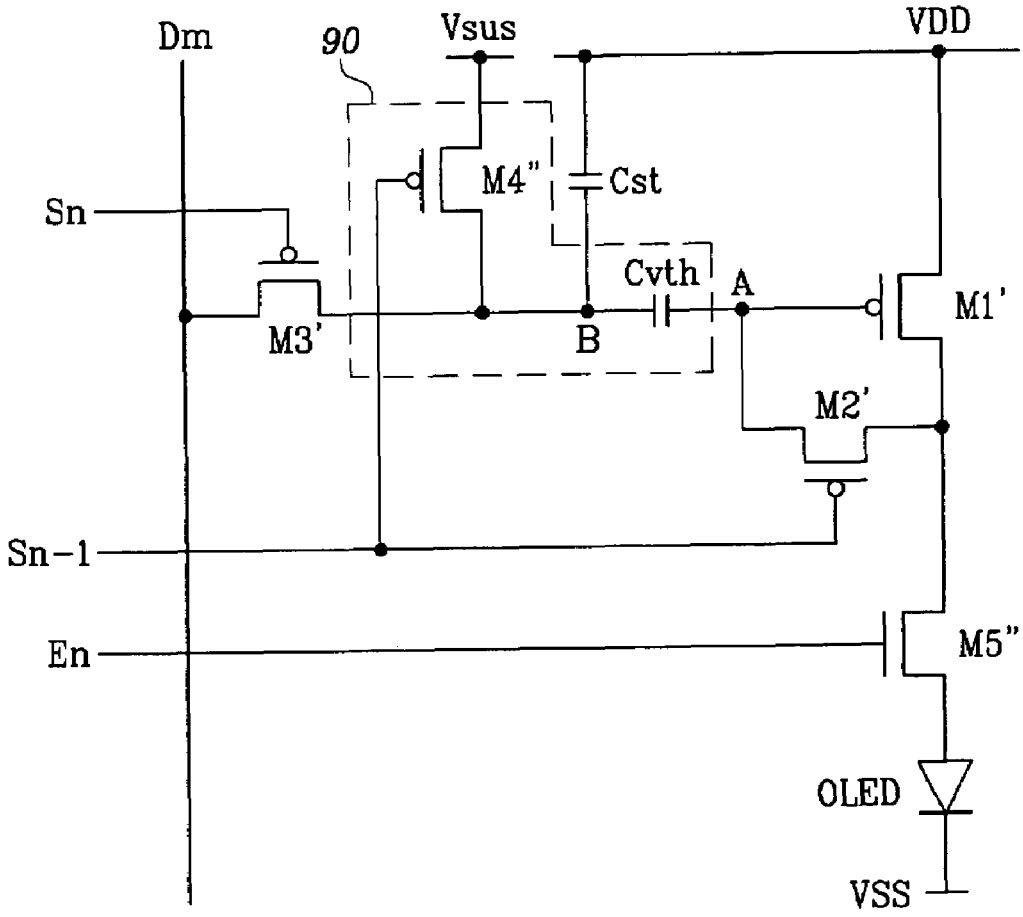
FIG. 9 shows a pixel circuit according to a third exemplary embodiment of the present invention.

FIG. 9 shows a pixel circuit according to the third exemplary embodiment of the present invention. The third exemplary embodiment includes a compensation device 90 that includes the transistor M4" and the capacitor Cvth.

The pixel circuit of FIG. 9 differs from the pixel circuit according to the second exemplary embodiment by controlling the transistor M5" by using a separate signal line En.

As shown, an N-type transistor is used for the transistor M5" for exemplary purposes, and the present invention is not thereby limited. The transistor M5" controls a light emission period of the pixel circuit of FIG. 9 independent from a select period of the previous scan line Sn−1 by the use of the separate signal line En to control the transistor M5".

Figure 10:
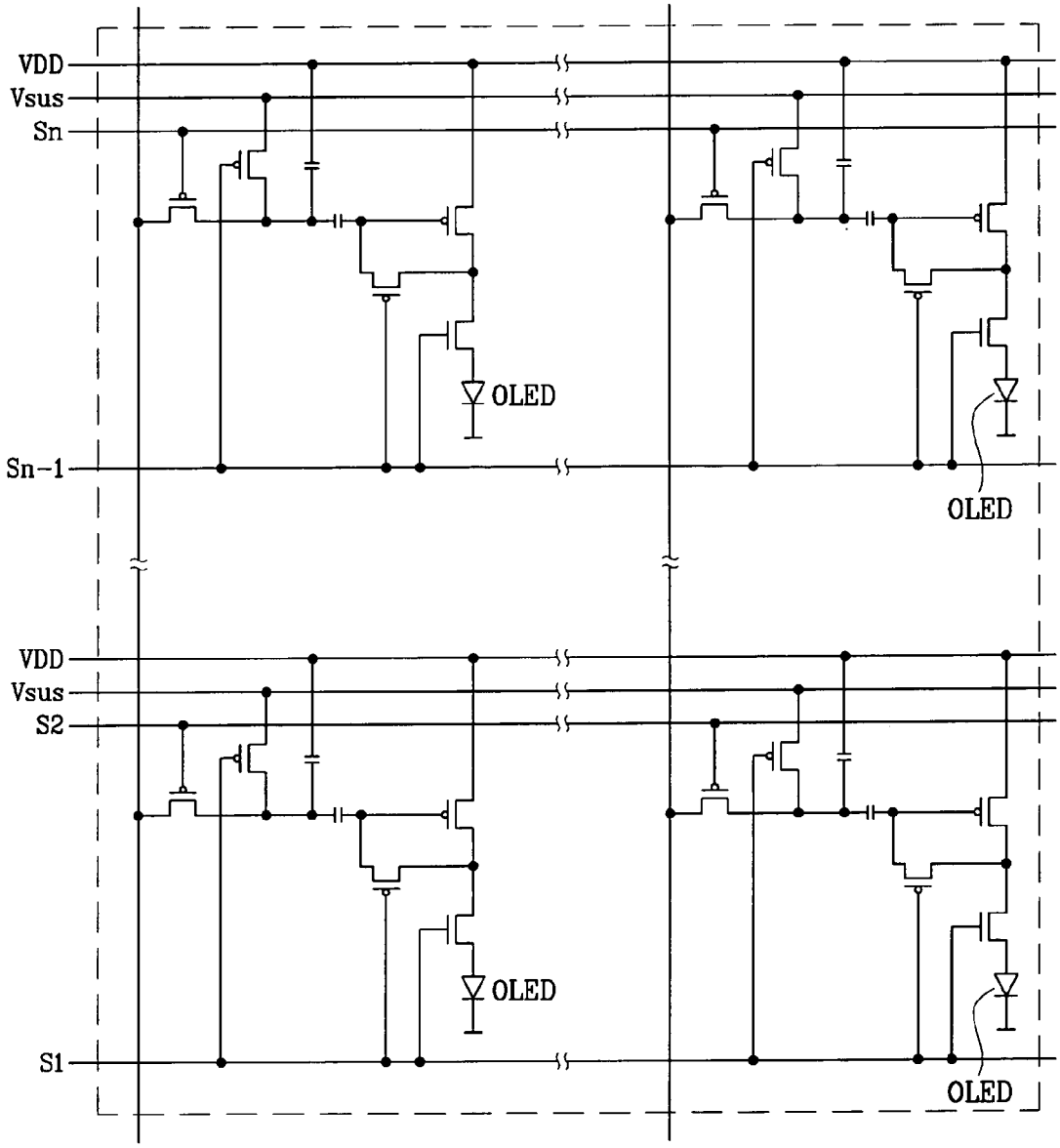
FIG. 10 shows a display panel of an organic EL display to which a pixel circuit according to the second exemplary embodiment is applied.

In general, according to the foregoing, FIG. 10 shows a panel (e.g., the panel 100 of FIG. 5) to which the pixel circuit according to the second exemplary embodiment is applied.

As shown, multiple pixel circuits are coupled to the voltage (VDD) supply line. A parasitic component is provided on the voltage (VDD) supply line on the display panel (e.g., the panel 100 of FIG. 5), and the voltage is dropped by the parasitic component. However, the non-uniform brightness phenomenon on the display panel caused by the voltage drop of the voltage (VDD) supply line is substantially eliminated because the current flowing to the organic EL element OLED is not influenced by the voltage VDD (and/or compensated by the voltage Vsus) according to the present invention.

While this invention has been described in connection with certain exemplary embodiments, it is to be understood that the invention is not limited to the disclosed embodiments, but, on the contrary, is intended to cover various modifications included within the spirit and scope of the appended claims and equivalents thereof.

What is claimed is:

1. A pixel circuit coupled to a first scan line for applying a first signal, a second scan line for applying a second signal, and a data line for applying a data voltage, the pixel circuit comprising:

a driving transistor including a control electrode, a first electrode coupled to a first power source, and a second electrode and for outputting a current corresponding to a voltage between the first electrode and the control electrode;

a display element coupled to the second electrode of the driving transistor and for displaying an image corresponding to the current output from the driving transistor;

a first switching transistor coupled between the control electrode of the driving transistor and the display element;

a compensation device for electrically coupling the control electrode of the driving transistor to a second power source in response to the first signal;

a storage capacitor coupled between the first power source and the compensation device; and a second switching transistor for applying the data voltage to the compensation device in response to the second signal.

2. The pixel circuit of claim 1, further comprising a third switching transistor for interrupting an electrical connection between the display element and the second electrode of the driving transistor in response to the first signal.

3. The pixel circuit of claim 1, wherein the compensation device comprises a compensation capacitor and a third switching transistor, the compensation capacitor having a first capacitor electrode coupled to the control electrode of the driving transistor and a second capacitor electrode, the third switching transistor electrically coupling the second capacitor electrode of the compensation capacitor to the second power source in response to the first signal.

4. The pixel circuit of claim 3, wherein the electrically coupling of the second capacitor electrode of the compensation capacitor and the second power source by the third switching transistor allows the display element to display the image corresponding to the current output from the driving transistor without influences from the first power source.

5. The pixel circuit of claim 1, wherein the current output from the driving transistor for displaying the image of the display element corresponds to the data voltage and a voltage of the second power source.

6. A display device including a plurality of data lines for applying a data voltage corresponding to an image signal, a plurality of scan lines for applying a select signal, and a plurality of pixel circuits coupled to the scan lines and the data lines, wherein at least one of the pixel circuits comprises:

a display element for displaying the image signal corresponding to an applied current;

a first transistor including a control electrode, a first electrode coupled to a first power source, and a second electrode coupled to the display element, the first transistor outputting the applied current corresponding to a voltage between the first electrode and the control electrode;

a first switch coupled between the control electrode of the first transistor and the display element and for receiving a first control signal;

a first capacitor having a first capacitor electrode coupled to the control electrode of the first transistor and a second capacitor electrode;

a second capacitor coupled between the first power source and the second capacitor electrode of the first capacitor;

a second switch for electrically coupling the second capacitor electrode of the first capacitor and a second power source in response to a second control signal; and a third switch for applying a data voltage provided by one of the data lines to the second capacitor electrode of the first capacitor in response to a first select signal provided by one of the scan lines.

7. The display device of claim 6, wherein the first control signal and the second control signal are applied to turn on the first and second switches before the first select signal is applied from the one scan line.

8. The display device of claim 6, further comprising a fourth switch for interrupting an electrical connection between the light emission element and the second electrode of the first transistor in response to a third control signal.

9. The display device of claim 8, wherein the third control signal is applied to the fourth switch during an interval in which the first and second control signals are applied to turn on the first and second switches, respectively.

10. The display device of claim 9, wherein the first and second switches comprise transistors doped to have a first type of major carriers, and the fourth switch comprises a transistor doped to have a second type of major carriers, and wherein the first type differs from the second type.

11. The display device of claim 10, wherein the first, second and third control signals are substantially the same signal.

12. The display device of claim 10, wherein the first, second, and third control signals comprise a second select signal provided by another one of the scan lines.

13. A display panel of a display device including a plurality of data lines for applying a data voltage corresponding to an image signal, a plurality of scan lines for applying a select signal, and a plurality of pixel circuits coupled to the scan lines and the data lines, wherein at least one of the pixel circuits comprises:

a display element for displaying the image signal corresponding to an applied current;

a transistor including a control electrode, a first electrode coupled to a first power source, and a second electrode coupled to the display element, the transistor outputting the applied current corresponding to a voltage applied between the control electrode and the first electrode to the second electrode;

a first capacitor having a first capacitor electrode coupled to the control electrode of the transistor and a second capacitor electrode; and a second capacitor coupled between the first power source and the second capacitor electrode of the first capacitor, and wherein the at least one pixel circuit is operated in the order of a first interval in which the second capacitor electrode of the first capacitor is coupled to a second power source to charge the first capacitor, a second interval in which the second capacitor is charged with a data voltage provided by one of the data lines, and a third interval in which the second electrode of the transistor and the display element are coupled to display the image signal.

14. The display panel of claim 13, wherein a voltage charged in the first capacitor substantially corresponds to a value obtained by subtracting a voltage of the second power source from a sum of a voltage of the first power source and a threshold voltage at the transistor.

15. The display panel of claim 13, wherein the second and third intervals are performed substantially at the same time.

16. The display panel of claim 13, wherein an absolute value of a value obtained by subtracting a voltage of the second power source from the sum of the data voltage and a threshold voltage at the transistor is established to be greater than an absolute value of the threshold voltage at the transistor.

17. The display panel of claim 16, wherein the voltage of the second power source is established to substantially correspond to the voltage of the first power source.

18. The display panel of claim 13, wherein the voltage applied between the control electrode and the first electrode of the transistor substantially corresponds to a value obtained by subtracting a voltage of the second power source from the sum of the data voltage and a threshold voltage at the transistor.

19. A method for driving a plurality of pixel circuits in a matrix format, wherein at least one of the pixel circuits includes a light emission element for emitting light in correspondence to an applied current, a transistor being coupled between a first power source and the light emission element and outputting the applied current corresponding to a voltage applied to a gate of the transistor, a first capacitor having a first capacitor electrode coupled to the gate of the transistor and a second capacitor electrode, and a second capacitor coupled between the first power source and the second capacitor electrode of the first capacitor, and wherein the method for driving the pixel circuits comprises:

(a) charging the first capacitor with a voltage of a second power source separately formed from a threshold voltage of the transistor and a voltage of the first power source;

(b) charging the second capacitor with a voltage corresponding to a data voltage provided by one of the data lines; and (c) driving the transistor according to the voltages charged in the first and second capacitors.

20. The method of claim 19, wherein (b) and (c) are performed substantially at the same time.

21. The method of claim 19, wherein the voltage charged in the first capacitor is substantially the same as a value obtained by subtracting the voltage of the second power source from a sum of the voltage of the first power and the threshold voltage of the transistor.

22. The method of claim 19, wherein an absolute value of a value obtained by subtracting the second voltage source from the sum of the data voltage and the threshold voltage of the transistor is established to be greater than an absolute value of the threshold voltage of the transistor.

* * * * *